US006244383B1

(12) United States Patent
Jung

(10) Patent No.: US 6,244,383 B1
(45) Date of Patent: Jun. 12, 2001

(54) LADDER SCAFFOLD DEVICE

(76) Inventor: Koock Elan Jung, 597 Bay Rd., Queensbury, NY (US) 12804

( * ) Notice: Subject to any disclaimer, the term of this patent is extended or adjusted under 35 U.S.C. 154(b) by 0 days.

(21) Appl. No.: 09/433,401

(22) Filed: Nov. 3, 1999

(51) Int. Cl.[7] ..... E06C 7/16; E04G 5/02

(52) U.S. Cl. ..... 182/121; 182/107; 182/214

(58) Field of Search ..... 182/121, 214, 182/107, 122, 117, 108, 116, 45, 206, 120; 248/238

(56) References Cited

U.S. PATENT DOCUMENTS

| | | | | |
|---|---|---|---|---|
| 3,318,415 | * | 5/1967 | Christie, Sr. | 182/116 |
| 3,491,852 | * | 1/1970 | Leist | 182/117 |
| 4,303,145 | | 12/1981 | Vazquez . | |
| 4,311,207 | * | 1/1982 | Lurry | 182/206 |
| 4,862,994 | | 9/1989 | Hughes . | |
| 4,941,547 | | 7/1990 | Livick . | |
| 4,949,810 | * | 8/1990 | Dwinnell | 182/214 |
| 5,165,501 | * | 11/1992 | Donahey | 182/214 |
| 5,624,006 | * | 4/1997 | Richardson, Jr. | 182/45 |
| 6,109,391 | * | 8/2000 | Tyson | 182/117 |

FOREIGN PATENT DOCUMENTS

| | | | | |
|---|---|---|---|---|
| 6280383 | * | 10/1994 | (JP) | 182/117 |

* cited by examiner

*Primary Examiner*—Daniel P. Stodola
*Assistant Examiner*—Hugh B. Thompson

(57) ABSTRACT

A ladder scaffold device attaches to a ladder to define a scaffold and work area for a user of the ladder scaffold device. The ladder scaffold device is capable of being inserted into at least one rung of the ladder. The ladder scaffold device comprises a platform; a platform frame, in which the platform frame comprises a first back frame member, a second frame member, first and second side frame members; and a front frame member; and a plurality of support members. The plurality of support members comprises platform support members and additional support members, in which the platform support members are capable of being inserted into a rung of the ladder. The first back frame member extends into a rung of the ladder and the second back frame member extends into the rung of the ladder that the first back frame member extends. Each of the side support members is capable of being connected to one of the first and second back frame members. The front frame member is capable of being connected to the side frame members, and the first back frame member, second frame member, first and second side frame members, and front frame member define a platform frame to support the platform that defines a scaffold and work area for a user of the ladder scaffold device.

7 Claims, 11 Drawing Sheets

FIG. 1
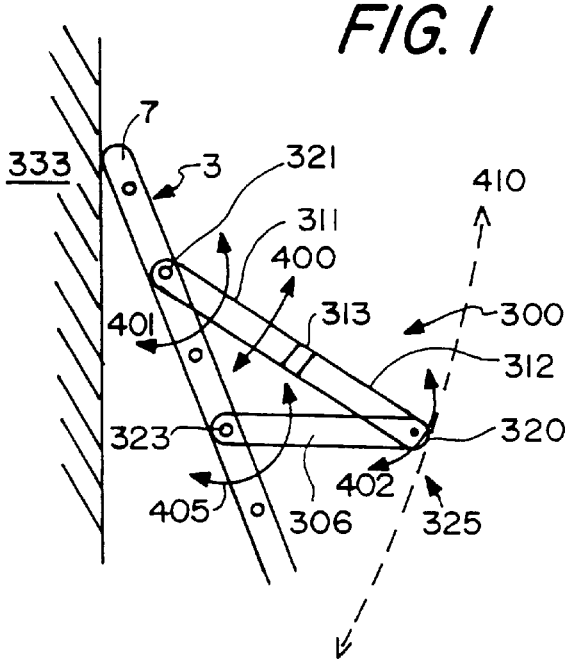
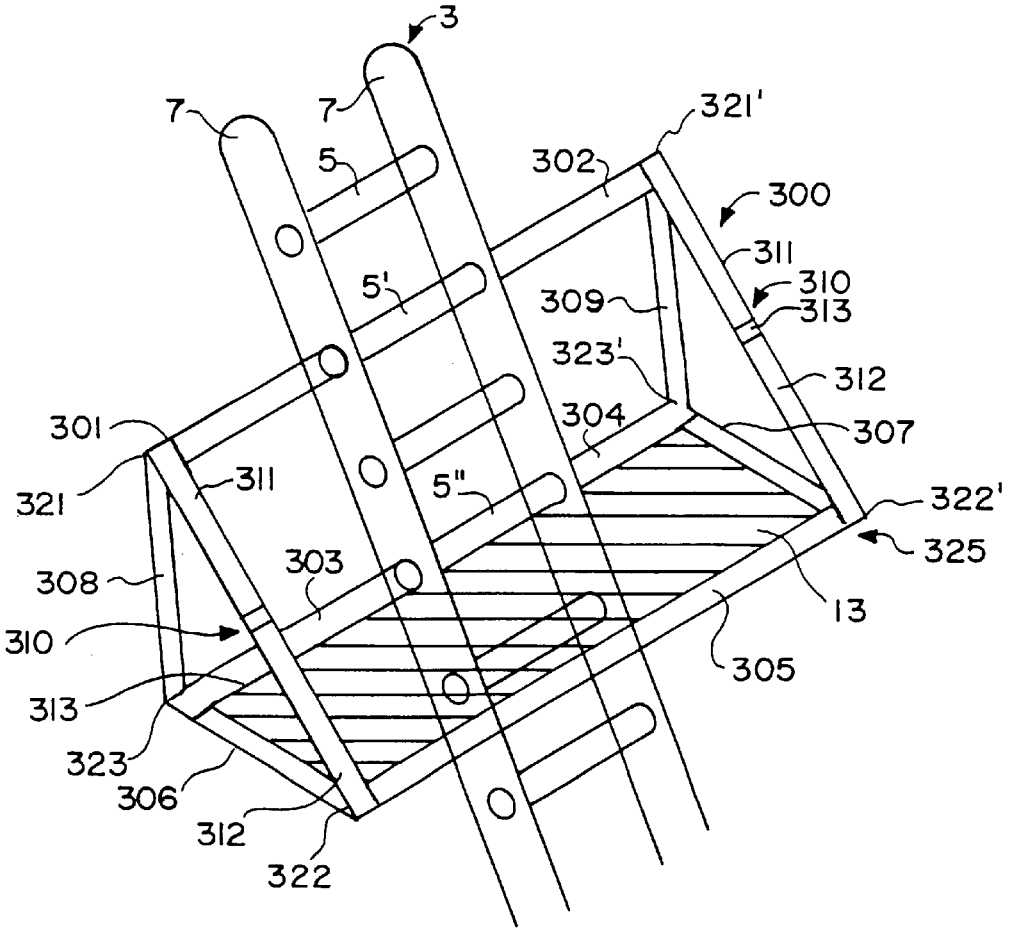
FIG. 2

LADDER SCAFFOLD DEVICE

BACKGROUND OF THE INVENTION

The invention relates to a ladder scaffold device. In particular, the invention relates to a ladder scaffold device that permits a single ladder to provide a scaffolding.

Scaffolding is a raised platform built as a support for workers and their tools and materials. A scaffolding provides an elevated, generally flat, surface so workers can move laterally, as well as vertically, while working at elevations. In contrast to ladders, which provide a worker with limited lateral range of movement often only as far as a worker can reach, a scaffolding provides enhanced lateral movement.

Scaffolding generally comprises a plurality of vertical, horizontal, and cross pieces that are interconnected to form a scaffolding frame. A platform is then joined to the scaffolding frame to define a work surface for workers. Often these scaffolding frame pieces, which are interconnected to form the scaffolding, require two or more individuals working in unison to assemble the scaffolding. Also, the raising of the platform up to the elevated portion of the scaffolding frame requires two or more individuals working in unison to lift, raise, and assemble the platform to the scaffolding frame. Accordingly, a single user may not be able to assemble a scaffolding for use.

A scaffolding platform, which is often a 2-by-10 or 2-by-12 board, can be connected between two ladders. A bracket is attached to each ladder and the board is hung from each bracket. The board then defines a platform for workers to move laterally. While a single person may attach a bracket to each ladder, the raising of a board to each bracket often requires two or more individuals working in unison to lift, raise, and assemble the board to the scaffolding frame. Accordingly, a single user is not be able to assemble this type of scaffolding for use.

Thus, a need exists for providing a scaffolding that a single person can assemble and use, without needing two or more individuals working in unison to lift, raise, and assemble the platform to the scaffolding frame.

SUMMARY OF THE INVENTION

A ladder scaffold device attaches to a ladder to define a scaffold and work area for a user of the ladder scaffold device. The ladder scaffold device is capable of being inserted into at least one rung of the ladder. The ladder scaffold device comprises a platform; a platform frame, in which the platform frame comprises a first back frame member, a second frame member, first and second side frame members; and a front frame member; and a plurality of support members. The plurality of support members comprises platform support members and additional support members, in which the platform support members are capable of being inserted into a rung of the ladder. The first back frame member extends into a rung of the ladder and the second back frame member extends into the rung of the ladder that the first back frame member extends. Each of the side support members is capable of being connected to one of the first and second back frame members. The front frame member is capable of being connected to the side frame members, and the first back frame member, second frame member, first and second side frame members, and front frame member define a platform frame to support the platform that defines a scaffold and work area for a user of the ladder scaffold device.

These and other aspects, advantages and salient features of the invention will become apparent from the following detailed description, which, when taken in conjunction with the annexed drawings, where like parts are designated by like reference characters throughout the drawings, disclose embodiments of the invention.

BRIEF DESCRIPTION OF THE DRAWINGS

FIG. 1 is a schematic, part-sectional side illustration of a ladder scaffold device, as embodied by the invention;

FIG. 2 is a schematic, part-sectional partial-side illustration of the ladder scaffold device of FIG. 1, as embodied by the invention;

DETAILED DESCRIPTION OF THE INVENTION

Figure 3:
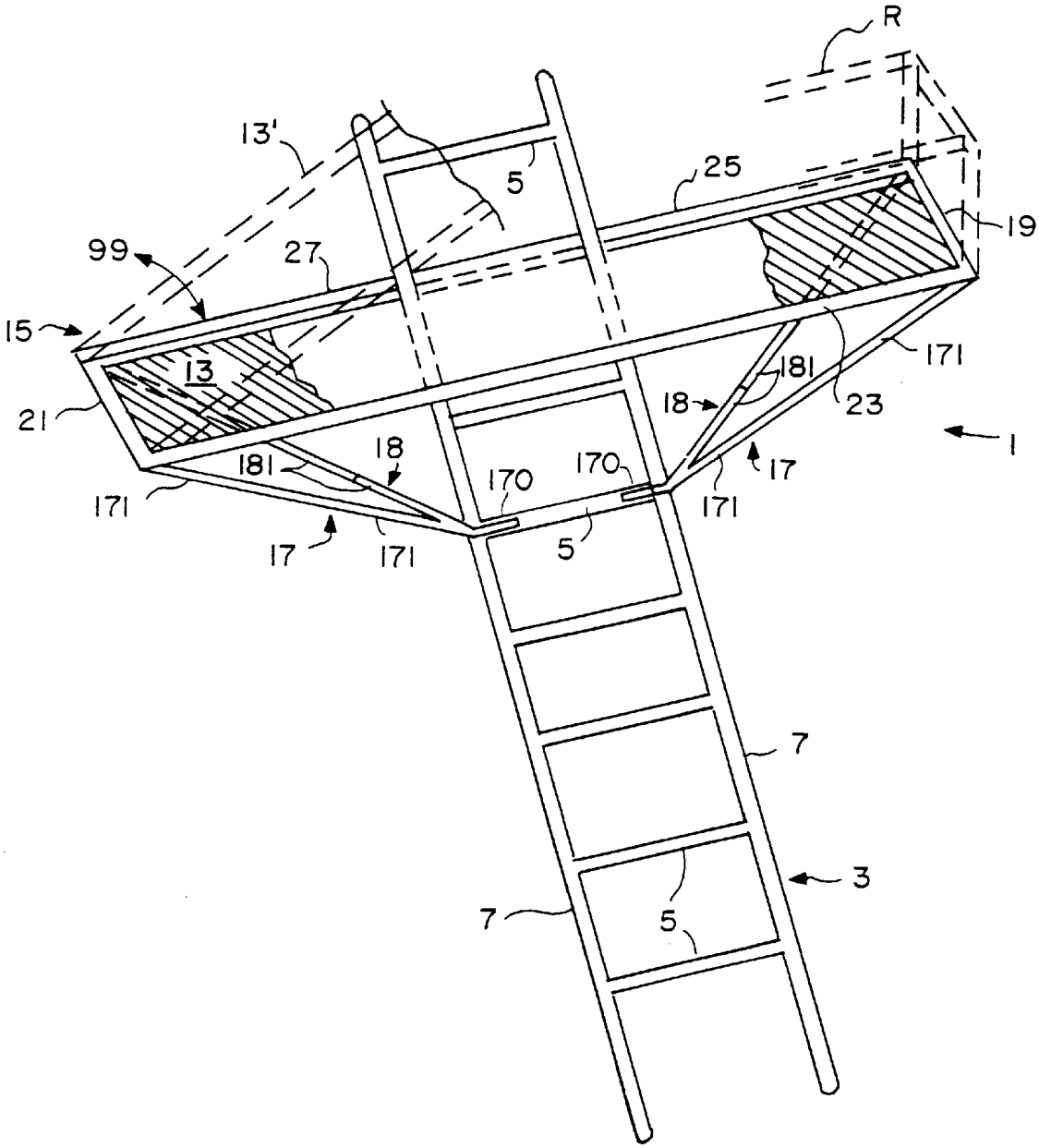
FIG. 3 is a schematic, part-sectional illustration of another ladder scaffold device, as embodied by the invention.

FIGS. 1 and 2 illustrate a ladder scaffold device 300, as embodied by the invention. The ladder scaffold device 300 comprises a platform 13 that is supported from a platform frame 325. The platform fame 325 is supported by a plurality of support members 308, 309, and 310, as discussed hereinafter.

Figure 4:
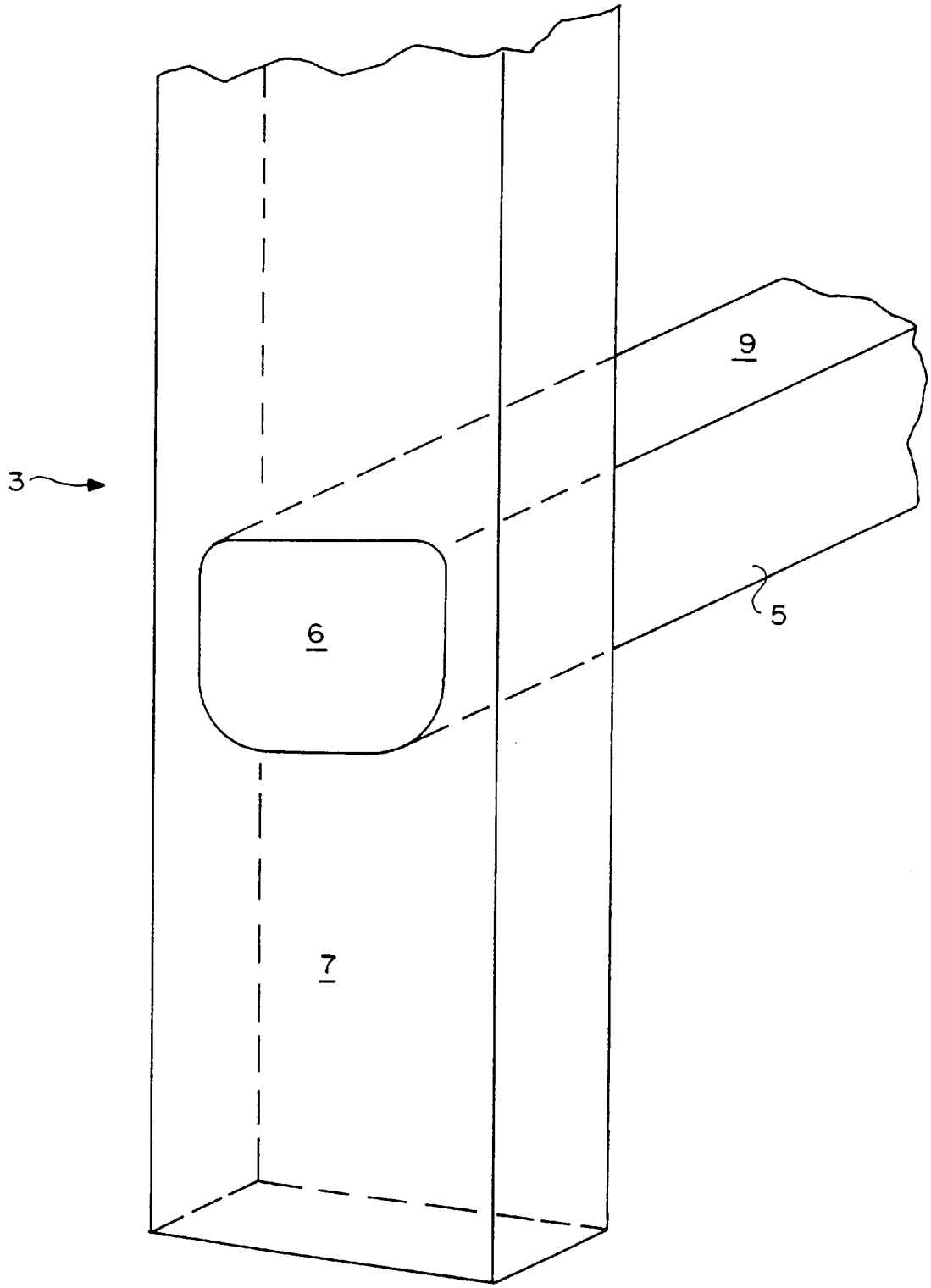
FIG. 4 is sectional view of a ladder rung, as embodied by the invention.

The ladder scaffold device 300 is supported from a ladder 3 in the following manner. Rung extensions 301 and 302 are supported and extendible from by a rung 5' of a ladder 3. The rung extensions 301 and 302 are fit into the rung 5' in a similar manner as illustrated in FIGS. 3 and 4 and described hereinafter. The second set of rung extensions 303 and 304 of the plurality of support members are supported and extendible from by a rung 5" of a ladder 3. The rung 5" is a lower rung on the ladder 3 when the ladder and ladder scaffold device 300 are positioned on a wall 333 that is to be worked on by a user compared to the rung 5'. The rung extensions 303 and 304 are fit into the rung 5" in a similar manner as illustrated in FIGS. 3 and 4 and described hereinafter.

Support members 308 and 310 are supported from the rung extension 301 in a pivotal fashion at pivot connection 321 so as to pivot about the rung extension 301. Similarly, support members 309 and 310 are supported from the rung extension 302 in a pivotal fashion at pivot connection 321' so as to pivot about the rung extension 302. The support members 310 comprise a multi-piece support member that comprises support components 311 and 312 and a folding hinge joint 313. The folding hinge joints 313 can comprise any appropriate joint construction that permits the support member 310 in the manner that will be described hereinafter, and permits movement in the direction of arrows 400, 401, 402, and 405 (FIG. 1).

The platform frame 325 comprises the rung extensions 303 and 304, side platform members 306 and 307, and a front platform frame member 305. The side platform members 306 and 307 are pivotally connected to the rung extensions 303 and 304 at pivot connections 323 and 323'. The front frame member 305 is pivotally connected to each side frame member and the support member components 312, in which the pivotal connections comprise 322 and 322'.

The platform 13 is supported on the platform frame 325 in a similar manner, as described hereinafter with respect to the ladder scaffold device 1 and ladder scaffold device 250. The ladder scaffold device 300 provides support for the platform 13 from above the level that the platform 13 is disposed in a hanging-support manner, compared to the ladder scaffold device 250 in FIGS. 19–22 in which the support is from below the level at which the platform 13 is disposed.

The ladder scaffold device 300 can be pivotally stored with the platform frame 325 and the support members essentially collinear with each side support 7 of the ladder 3. For example, the folding hinge joints 313 may move in the direction of arrow 400, as the support member 310 and hinge joint 313 are moved toward the side rails 7 of the ladder 3. Similarly, when the support member 310 and hinge joint 313 are moved in this manner, the side platform members 306 and 307 pivot upwardly in the direction of arrow 405, and the connection area for the side platform members and the front platform frame member 305 move upwardly in the direction of arrow 410. Also, movement of the platform frame member follows a movement in the general direction of arrow 404.

The arrangement of the supports members 308-310 extending from rung extensions 301 and 302 that are inserted into a rung 5' provides hanging support for the ladder scaffold device 300, with the platform being generally hung therefrom. Further, the rung extensions 303 and 304 that extend from a rung 5" below the rung 5' provides further support for the platform 13 and the ladder scaffold device 300. The platform 13 is similar in construction and arrangements as the configurations of the platform discussed hereinafter.

Another ladder scaffold device 1, as embodied by the invention, is illustrated in the FIGS. 3. The ladder scaffold device 1 is attached to a ladder 3. The ladder 3 is of conventional structure. For example, the ladder 2 comprises, but is not limited to, an extension ladder, however, the scope of the invention comprises inclusion of the ladder scaffold device 1 with any ladder, such as but not limited to a step ladder, an extension ladder, a scaffold/ladder combination, and combinations thereof. The invention will be described with reference to an extension ladder 3 (hereinafter "ladder"), however this description is merely exemplary, and is not meant to limit the invention in any way.

The ladder 3 comprises side rails 7, typically two side rails, and a plurality of rungs 5. The rungs 5 of the ladder 3 are disposed between the side rails 7 in a typical ladder construction. The rungs 5 are connected to each side rail 7 so as to provide structural integrity to the ladder 3, as is known in the art. In other words, the rungs 5 keep the side rails 7 of the ladder 3 from moving away from each other.

The rungs 5 define foot and hand holds for a person who will be climbing the ladder 3. The rungs 5 are typically provided in any appropriate configuration for ease of gripping by hand and standing upon with one's feet. Thus, each rung 5 can be formed with a hollow interior 6, and is configured with a round cross-section, an oval cross-section, other arcuate cross-section configuration, and with a generally flat upper surface 9 (FIG. 4). The rung 5, in which the ladder scaffold device 1 is provided (as described hereinafter) may be an existing rung 5 of the ladder 3 that comprises the generally hollow interior 6.

Figure 16:
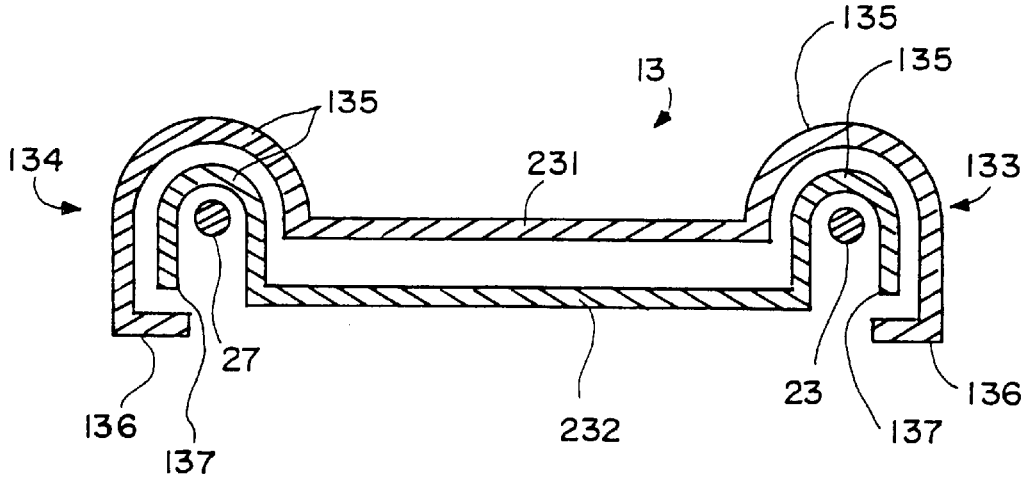
FIG. 16 is schematic illustration of a platform, as embodied by the invention.

The ladder scaffold device 1, as embodied by the invention, comprises a platform 13, a platform frame 15, and platform support members 17, as illustrated in FIG. 3. In FIG. 3, the platform 13 of the ladder scaffold device 1 is illustrated partially in section in FIG. 3 to allow illustration of the other features of the ladder scaffold device 1. The platform 13 and associated structures are described in further detail hereinafter with respect to FIGS. 16–18.

The platform frame 15 comprises a plurality of members. The members include side frame members 19 and 21, a front frame member 23, a first back frame member 25, and a second back frame member 27. The side frame members 19 and 21, a front frame member 23, a first back frame member 25, and a second back frame member 27 will be collectively referred to hereinafter as "frame members". The frame members are formed from an appropriate material that can support the weight that will be loaded thereon. For example, the frame members can be formed of metals, such as but not limited to, steels, aluminum, and alloys thereof, composites, plastics, and combinations thereof.

The first and second back frame members 25 and 27 extend into the hollow interior 6 of a rung 5 of a ladder 3. The first and second back frame members 25 and 27 are formed with a configuration that is complementary to the interior 6 of the rung 5. For example, and in no way limiting of the invention, the first and second back frame members 25 and 27 are formed with a top surface that is generally flat to correspond to the generally flat upper surface 9. The rung 5 that accepts the first and second back frame members 25 and 27 is typically located proximate the top portion of the ladder 3, however the position of the ladder scaffold device 1 can be anywhere on the ladder 3, and the illustrated position of FIG. 3 is merely exemplary, and is not intended to limit the invention in any manner.

Figure 5:
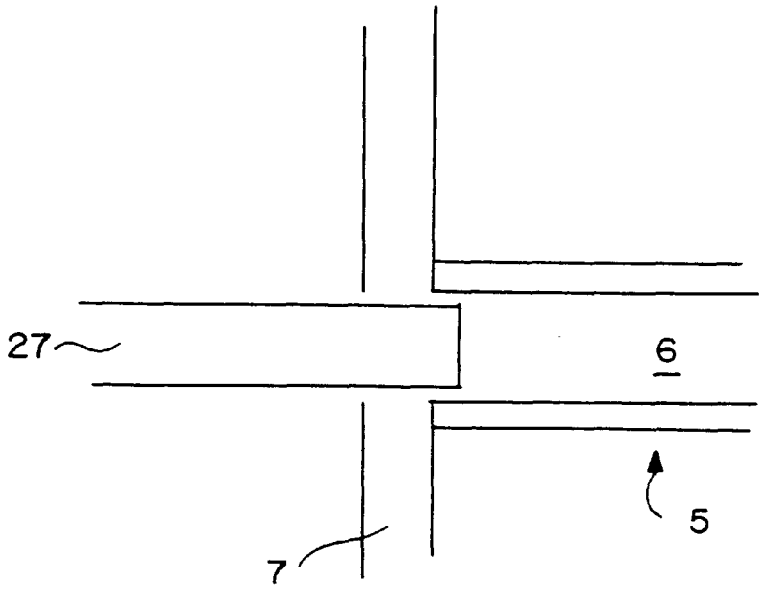
FIG. 5 is schematic illustration of a connection of a frame member in a ladder rung, as embodied by the invention.

The first and second back frame members 25 and 27 can be simply slid into the rung 5, as illustrated in FIG. 5. The first and second back frame members 25 and 27 are slid into the rung 5 to a designated insertion length, which provides stability to the ladder scaffold device 1. Alternatively, as illustrated in FIG. 6, the first and second back frame members 25 and 27 can include a stepped portion 28 that limits the extent of insertion onto the hollow interior 6 of the rung 5.

Figure 6:
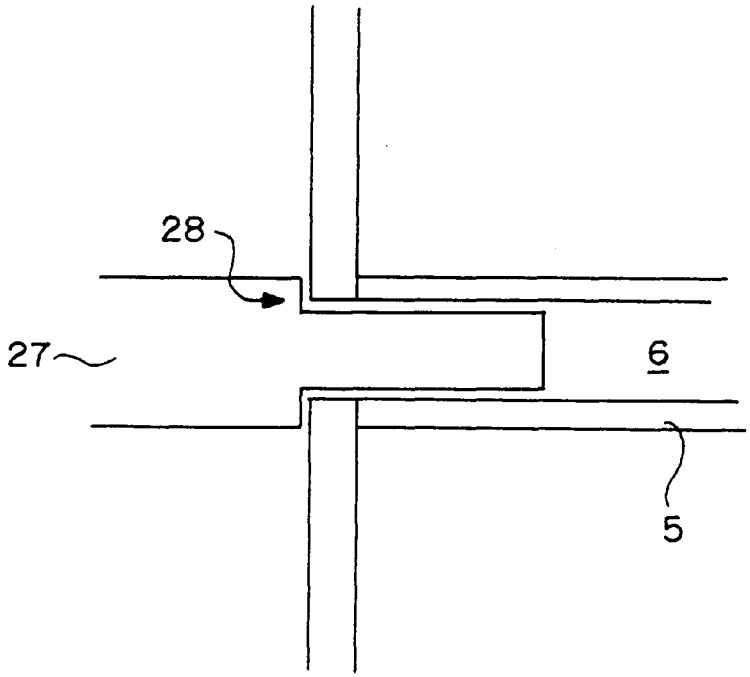
FIG. 6 is schematic illustration of another connection of a frame member in a ladder rung, as embodied by the invention.

In either of the configurations of FIGS. 5 and 6, one or both of the first and second back frame members 25 and 27 can include a locking device or mechanism 10 that secures the first and second back frame members 25 and 27 in a set position in the rung 5. The locking devices 10 are illustrated in FIGS. 7–13. The locking device 10 of the ladder scaffold device 1 comprises an assembly that is easily operated by a user to permit insert and lock and unlocking of the ladder scaffold device 1. Therefore, insertion, removal, and movement of the ladder scaffold device 1 into a rung 5 is possible. Examples of some locking devices 10 and associated assemblies within the scope of the invention will now be discussed with respect to FIGS. 7–13. These examples are merely exemplary of the locking devices within the scope of the invention, and are not intended to limit the invention in any manner.

Figure 7:
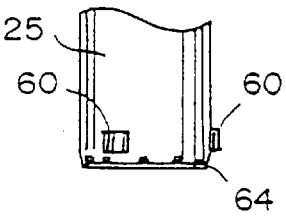
FIG. 7 is a schematic illustration of a locking device, as embodied by the invention.
Figure 8:
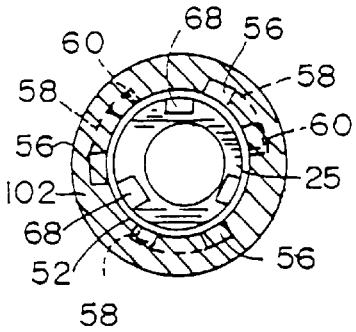
FIG. 8 is a schematic illustration of the locking device of FIG. 7, as embodied by the invention.
Figure 9:
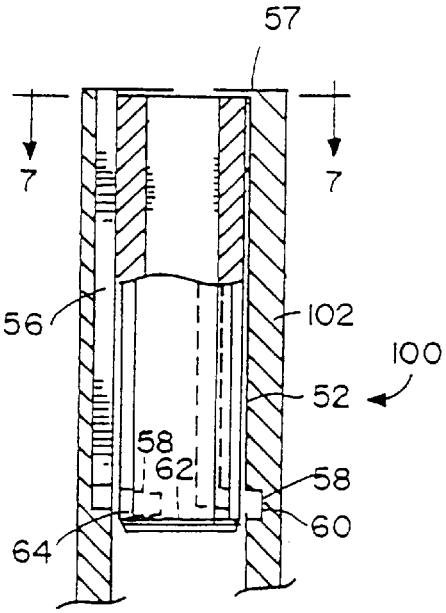
FIG. 9 is a schematic illustration of the locking device of FIG. 7, as embodied by the invention.

One exemplary locking device 10 that comprises a bayonet-type locking device 100 (hereinafter referred to as "bayonet-connection locking device"), as embodied by the invention, is illustrated in FIGS. 7–9. The bayonet-connection locking device 100 comprises at least one lug 60 that is disposed on one of the first and second back frame members 25 and 27 (the figures illustrate one back frame member 25, however this is merely to simplify the illustrations). The bayonet-connection locking device 100 cooperates with at least one slot 58 that is disposed on a section 102 of a rung 5 for the ladder scaffold device 1. The bayonet-connection locking device 100 illustrated in FIGS. 7–9 shows lugs 60 on a back frame member 25 and slots on a cooperating, adjacent second section 102. The back frame member 25 is nested in the second section 102 in a telescoping nature. The scope of the invention includes lugs and slots on either of the back frame 25 and the section 102 of the ladder scaffold device 1. Accordingly, as embodied by the invention, the structure and features disposed on the back frame member 25 may be disposed on the other section 102 and the structure and features disposed on the section 102 may be disposed on the back frame member 25, and the discussion of features of each section may apply to the other section.

The back frame member 25 is secured in a bore 52 of the other section 102 by the bayonet connection 100. The back frame member 25 comprises a step 55 in a first diameter that separates a larger diameter portion of the bore 52 from a lower portion of the bore 52. The larger diameter of the bore 52 comprises a series of spaced, parallel grooves or bayonet channels 56 that extend along the length of the bore 52 from an upper end 57 of the section 102. The back frame member 25 may comprise cooperating, similarly shaped structure to the spaced, parallel grooves or bayonet channels 56 to prevent undesired rotation of the back frame member 25 and section 102. A downwardly inclined, transverse locking slot 58 extends in a generally circumferential direction from the lower end of each channel 56. The inclined, traverse locking slot 58 comprises a detent at its lowermost end. In FIGS. 7–9, three bayonet channels 56 are illustrated, however this is merely exemplary and not meant to limit the invention in any manner. The scope of the invention comprises a greater or lesser number of bayonet channels, if desired.

The back frame member 25 comprises a plurality of spaced bayonet lugs 60 that project from its outer surface adjacent the lower end 62 of the section, for sliding engagement along the bayonet channels 56 as the back frame member 25 is inserted into the bore 52 of section 102. The structure, as illustrated, shows three such lugs 60, however this is merely exemplary and not meant to limit the invention in any manner. The scope of the invention comprises a greater or lesser number of lugs, if desired.

Each lug 60 may comprise a slight incline or ramped lower surface. Once the lugs 60 enter the lower ends of the respective channels 56, the section is rotated in a clockwise direction. Therefore, the lugs 60 travel along transverse slots 58. Also, at the same time, the back frame member 25 is urged axially downwardly, due to the incline of the slots 58 and the ramped lug surfaces. The back frame member 25 is rotated until each lug reaches the detent at the lower end of each slot 58, releasably locking the insert in the bore 52.

Figure 10:
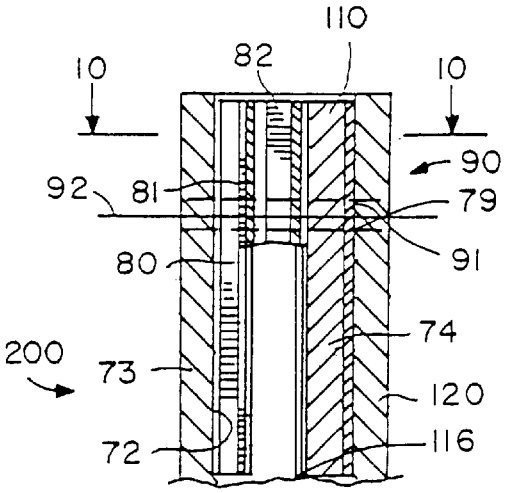
FIG. 10 a schematic illustration of another locking device, as embodied by the invention.
Figure 11:
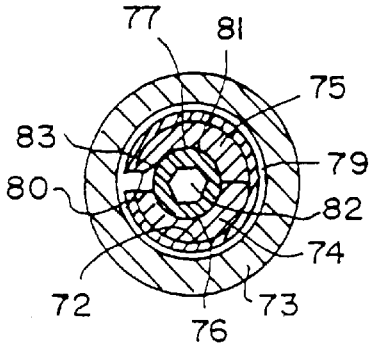
FIG. 11 is a schematic illustration of the locking device of FIG. 10, as embodied by the invention.
Figure 12:
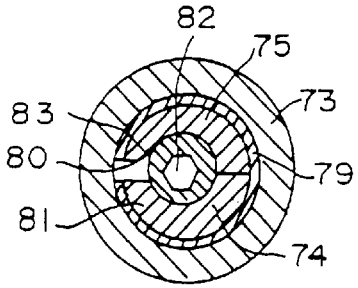
FIG. 12 is a schematic illustration of the locking device of FIG. 10, as embodied by the invention, as embodied by the invention.

FIGS. 10–12 illustrate a further alternative locking device 200. The locking device 200 locks a frame section 110 and a section 120 of the rung 5 together. Section 110 of the locking assembly 200 is insertable into a bore 72 of the section 120. Section 110, as embodied by the invention and illustrated in FIGS. 10–12, comprises two semi-cylindrical half members 74 and 75.

Each of the semi-cylindrical half members 74 and 75 comprise partially semi-circular recesses 76 and 77, which are disposed with respect to other at their mating flat faces. The semi-cylindrical half members 74 and 75 comprise at least partially semi-circular recesses 76 and 77 that together define a through-bore that extends through the section 110. The semi-cylindrical half members 74 and 75 may alternatively be held in a "C"-shaped metal sleeve or sheath 79. The sleeve 79 may be formed with differing wall thicknesses, so that the section 110 can be fit in different diameter bores 72.

One of the recesses 77 comprises an eccentric cut-out 80, which is illustrated in FIGS. 11 and 12. The eccentric cut-out 80 comprises screw threads (not illustrated for ease of understanding) that are in threaded engagement with a central actuating connector 81, such as a screw, (hereinafter referred to as "central actuating connector 81"). The central actuating connector 81 is attached to section 110 to be able to rotate therewith. The central actuating connector 81 comprises a projecting cam surface 83. The projecting cam surface 83 is located in the eccentric cut-out 80 when the central actuating connector screw 81 is in an inoperative position, as illustrated in FIG. 11.

Figure 13:
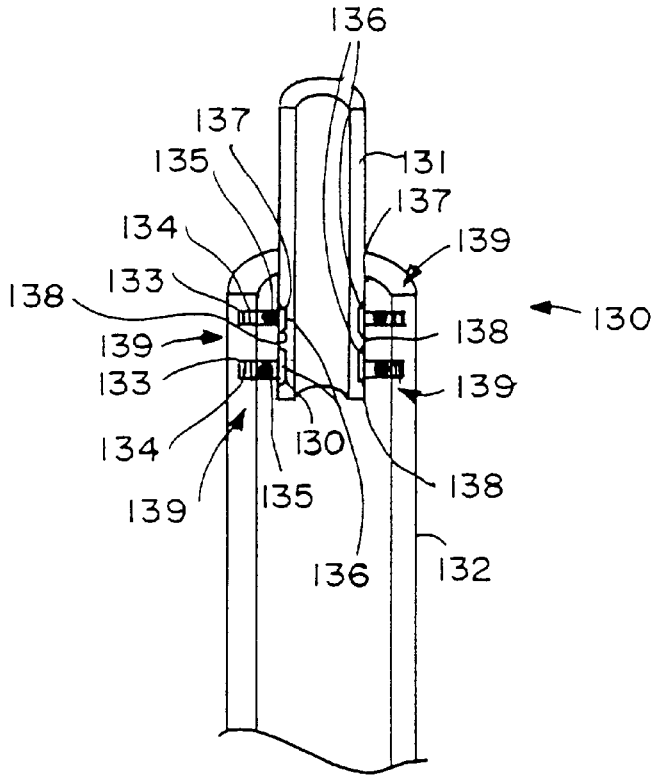
FIG. 13 is a schematic illustration of another locking device, as embodied by the invention, as embodied by the invention.

To install and lock the section 110 into the section 120, section 110 is disposed in the bore 82 of section 120. The section 110 is then pushed in a direction that is generally axially downwardly into channel 72. The central actuating connector screw 81 is then rotated in a clockwise direction. The rotation causes the cam surface 83 to move out of cut out 80. The cam surface 83 then urges the semi-cylindrical half members 74 and 75 apart from each other. The semi-cylindrical half members 74 and 75 expand the effective diameter of the section 110, as illustrated in FIG. 13. The outer surface of the expanded sleeve 79 will then bear against the inner surface of bore 72. Frictional engagement between the two surfaces of the sections 110 and 120 will hold and lock the section 110 in the bore 72 of section 120.

As an alternative to the above-described locking device structure, a tapered screw may be used to expand the semi-cylindrical half members 74 and 75. Therefore, the tapered screw gradually increases diameter of the semi-cylindrical half members 74 and 75, and urges the two semi-cylindrical half members apart into a locking position.

FIG. 13 illustrates a further locking device structure 130. The locking device 130 comprises at least one spring-biased section locking detent assembly 139 to lock a frame section 131 and a rung section 132 in an extended, non-retractable position. Each spring-biased section locking detent assembly 139 comprises a bore 133 that is disposed one of the sections 131 and 132. In FIG. 13, the bore 133 is illustrated disposed in section 132 of the adjacent sections 131 and 132, however this positioning is merely exemplary. The bore 133 can be disposed in either of the sections 131 and 132 with the complementary detent recess structure being disposed in the other of the sections 131 and 132. A spring 134 is positioned in each bore 133 so as to bias a locking ball 135 out of the bore 133. The adjacent sections 131 comprise a plurality of detent recesses 136. FIG. 13 illustrates opposed sets of two detents recesses 136 each, however this structure is merely exemplary, and is not intended to limit the invention in any manner. The number and positioning of the detent recesses 135 are complementary to the number and positioning of the bore detent assemblies 139.

Each recess 136 comprises a front slanting wall 138 that permits ingress and egress of the ball 135 from the recesses 136. The last recess of the bore detent assembly 139 comprises a generally vertical wall 137 that prevents the ball 135 from being withdrawn from the recess 136. Therefore, the bore detent assembly 139 maintains the sections 131 and 132 in a locking position to stabilize them.

Each of the above-described locking devices 10 may further comprise a locking pin assembly 90 that further supports and locks the sections in an extended position. The locking pin assembly 90 of the locking device 200 is illustrated in FIG. 10 for ease of illustration, and although the locking pin assembly 90 can be used on all lock devices within the scope of the invention, and this illustration is not intended to limit the invention in any manner. The locking pin assembly 90 comprises locking mechanisms on adjacent sections of the plurality of sections. The locking pin assembly 90 comprises a through hole 91 (in phantom in FIG. 10) aligned in each adjacent section and a cooperating locking pin 92. The locking pin 92 extends through the through hole 91 to lock the adjacent sections with each other. The locking pin assembly 90 maintains the sections in a stable and extended position, and movement between adjacent sections is not possible with the locking pin 90 engaged.

Figure 14:
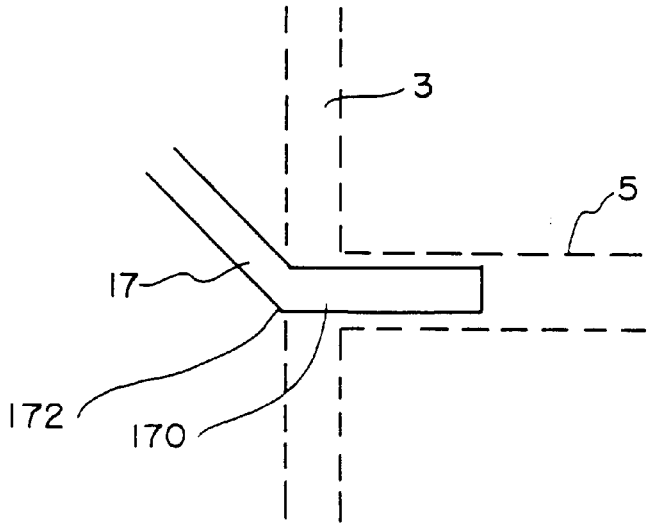
FIG. 14 is a schematic illustration of a connection of a platform support member in a ladder rung, as embodied by the invention.
Figure 15:
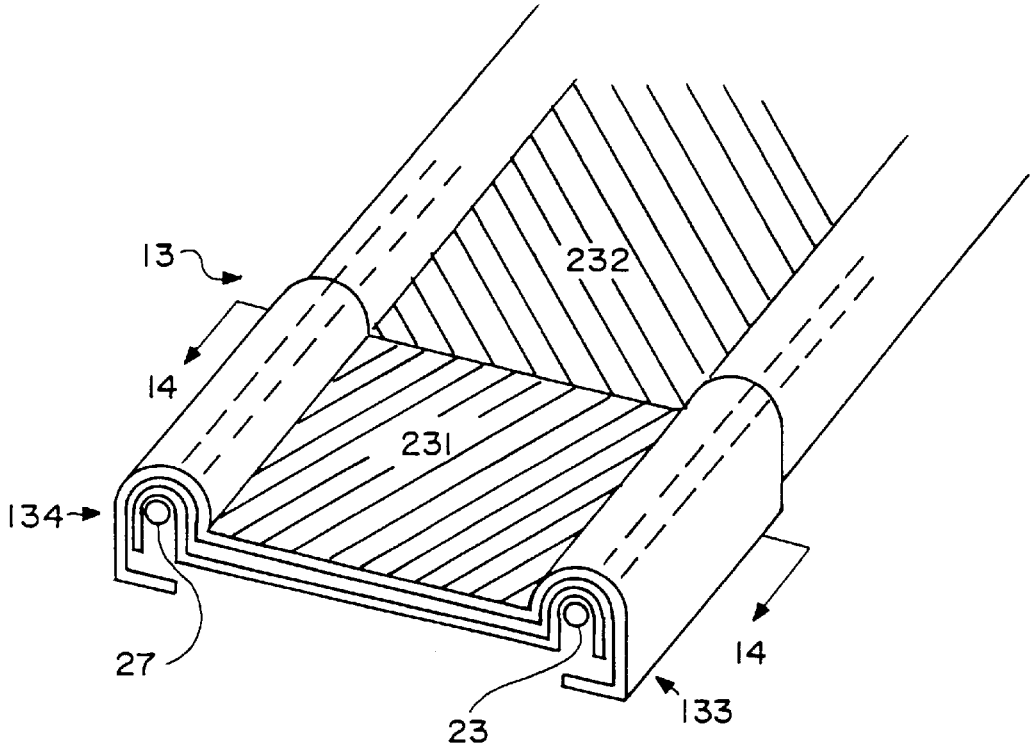
FIG. 15 is schematic illustration of a platform, as embodied by the invention.

FIG. 14 illustrates a connection of an insert portion 170 of a platform support member 17 into a rung 5. The insert portion 170 can be formed integrally with the platform support member 17 in a one-piece fashion or as separate units connected together in an integral fashion. The insert portion 170 can comprise an elbow 172, which can limit the depth of insertion of the platform support member 17 insert portion 17 into the rung 5. Locking devices, as discussed above with respect to FIGS. 7–13, may be sued in conjunction with the insert portion 170 to lock the insert portion 170 in the rung 5. Alternatively, the insert portion of the platform support member 17 may comprise structures as set forth in FIGS. 5 and 6 to fit the platform support member 17 insert portion 170 in the rung 5.

The platform 13 and its cooperation with the platform frame 15 is illustrated in detail in FIGS. 15–18. The platform 13 comprises at least two platform members 231 and 232, which are slidably engaged with each other in a mating fashion. The platform 13 with the slidable connection between platform members 231 and 232 is able to extend to sizes to match the size of the platform frame 15, when the platform frame 15 has been extended and adjusted to the desired configuration for use. As illustrated, one of the platform members is slidable on top of the other platform members. The figures illustrate platform members 2131 with a larger size to be slide on the platform members 232, however this is merely exemplary, and any one of the platform members can be slid on the other platform members.

Each platform member comprises a platform frame engaging member that engages the front frame member 23, a first back frame member 25, and a second back frame member 27. As illustrated, each platform member includes frame engaging portions, that as illustrated are formed with a complementary configuration with each of the front frame member 23, first back frame member 25, and second back frame member 27. For example, each platform member comprises engaging portions 133 and 134. One of the engaging portions encircles a respective frame member and the outer one of the platform member encircles the other of the platform member in a slidable configuration. Accordingly, the platform members 231 and 232 may slide with respect to each other to extend and interact with the side frame members 19 and 21, as discussed hereinafter.

The engaging portions each comprise a first engaging portion 135 that encircles the front frame member 23, first back frame member 25, and second back frame member 27. The outer extends a further distance around each of the front frame member 23, first back frame member 25, and second back frame member 27 and terminates in a tab 136. The tab 136 extends toward the front frame member 23, a first back frame member 25, and a second back frame member 27, and also extends toward the other platform member end 137. Thus, the tab 136 prevents the platform member with the tab 136 from being separated from the other of the platform members.

The platform member 13 attaches to the side frame members 19 and 21 and can be extended to fit between each of the side frame members 19 and 21. The attachment to one of the side frame members 19 and 21 permits the platform member 13 to be pivoted about one of the side frame members 19 and 21 so the platform member 13 can be moved in the direction of arrow 99 to allow a user of the ladder scaffold device 1 to climb the ladder 3 and use the ladder scaffold device 1. The user of the ladder scaffold device 1 is able to pivot the platform member 13 abut one of the side frame members 19 and 21 to a raised position 13', which is illustrated in phantom in FIG. 3.

Figure 17:
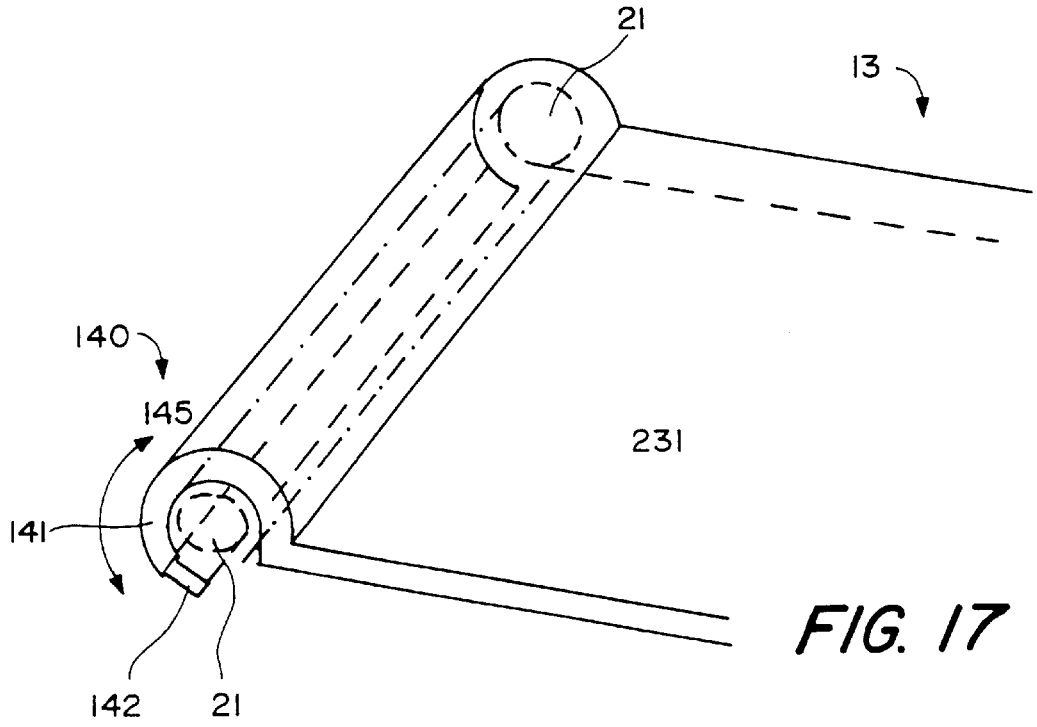
FIG. 17 is schematic illustration of a platform, as embodied by the invention.
Figure 18:
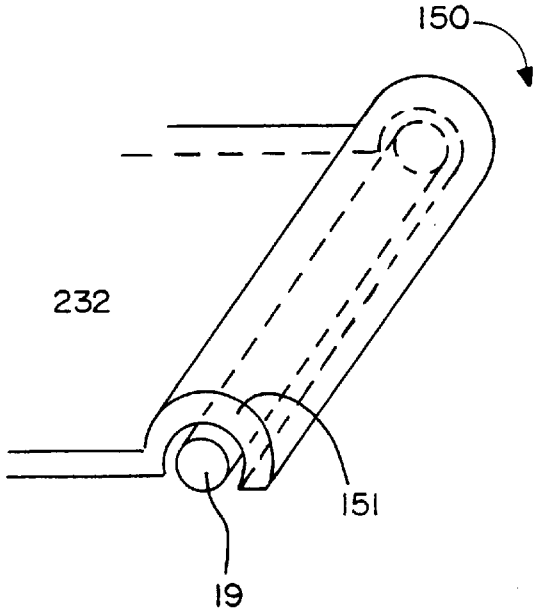
FIG. 18 schematic illustration of a platform, as embodied by the invention.

The connection 140 of the platform member 13 to one of the side frame members 19 and 21 is illustrated in FIG. 17, while the other connection 150 of the platform member 13 to the other of side frame members 19 and 21 is illustrated in FIG. 18. FIGS. 17 and 18 illustrate the connection 140 on the side frame member 21, and the connection 150 on the side frame member 19, however the illustrations are merely exemplary, and the connections may be to the other of the side frame members 19 and 21.

The connection 140 includes a rounded connector 141 that is able to pivot in the direction of arrow 145. The rounded connector 141 may comprise a single solid component that encircles the side frame member 21 in which the rounded connector 141 is attached to the side frame member 21. Alternatively, the rounded connector 141 can comprise an extension 142 that may be retractable into the rounded connector 141. In this manner, the platform member 13 can be removable from the side frame member 21 for assembly and use of the ladder scaffold device 1 as described hereinafter.

The connection 150 comprises a rounded connection 151 that fits onto the side frame member 19. The rounded connection 151 fits onto the side frame member 19 in a freely capable of being lifted, so that when the platform member 13 is pivoted about the other of the side frame members 19 and 21, the connection 151 fits easily onto and off the side frame member 19.

Each of the platform support members 17 can comprise connected sections or segments 171, which are extendible to fit between the rung 5 and the point at which it supports the platform 13. The segments 171 of the platform support members 17 can be extended with respect to each other and locked in an extended position using the locking members, as discussed above with respect to FIGS. 7–13.

Figure 19:
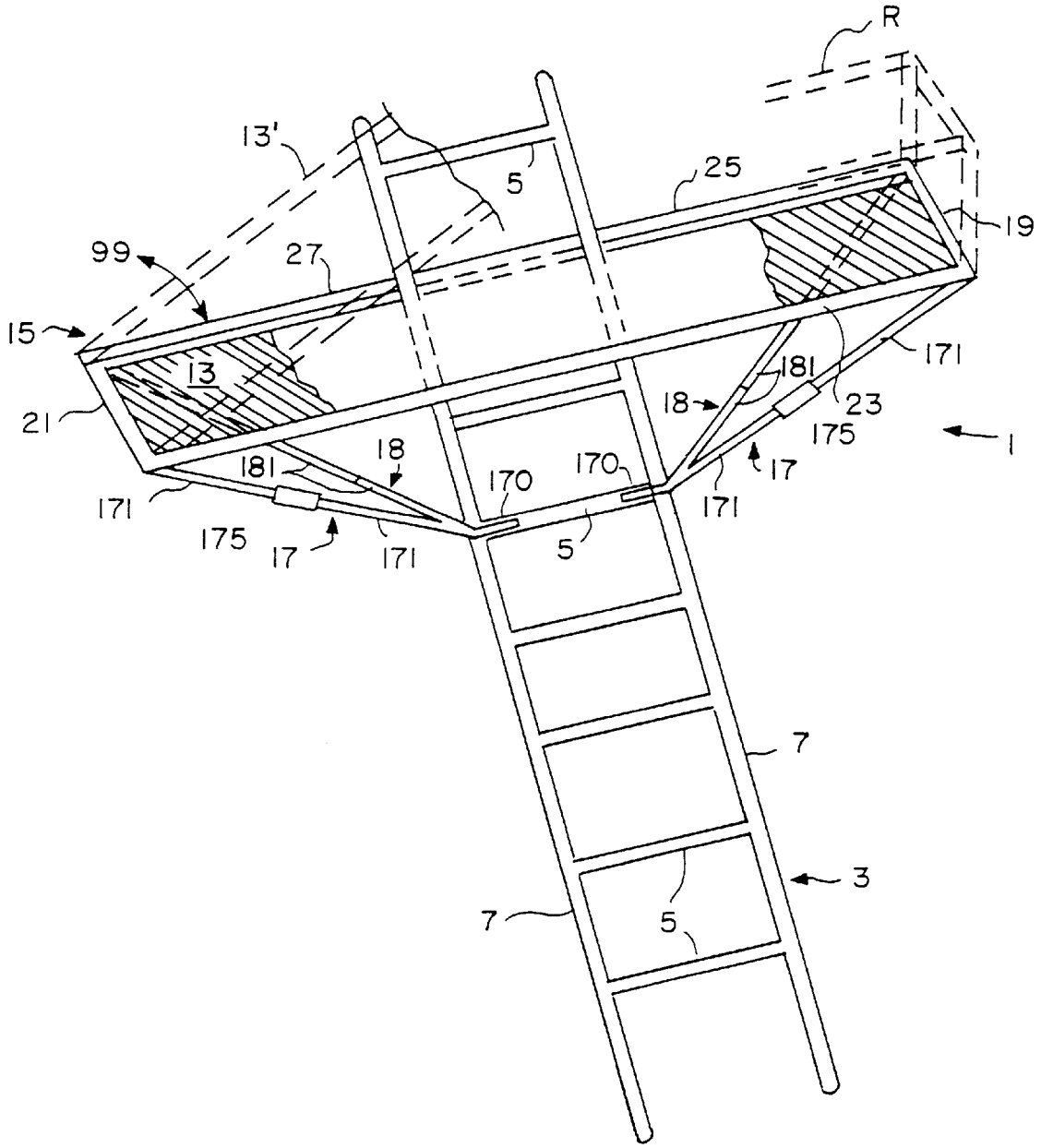
FIG. 19 is schematic, part-sectional illustration of another ladder scaffold device, as embodied by the invention.

Each of the platform support members 17 may alternatively comprise a platform support member motive device 175, as illustrated in FIG. 19. The platform support member motive device 175 is connected respective segments 171 of the platform support members 17. The platform support member motive device 175 can be operated and can extend the segments 171 into engagement with each respective portion of the platform frame 15 and its members 19, 21, 23, 25, and 27. The segment 171 that contacts and connects with the platform frame 15 and its members 19, 21, 23, 25, and 27 is connected by any appropriate connection, such as but not limited to, a simple friction engaging connection, a ball-and-socket connection, and interference connection, a clamp, a hook and pin connection, and other similar connections.

The platform support members 17 that are capable of being extended by the platform support member motive device 175 is able to maintain its strength when extended. The platform support member motive device 175 can comprises any appropriate motive device, such as but not limited to, a stepper motor, an electric motor, a small gas-powered motor, and other similar motive device. The platform support member motive device 175 provides a structurally stable unit that does not present a weak point in the support member 17.

A further support member 18 is also provide in the ladder scaffold device 1 to provide further lateral support for the ladder scaffold device 1 and the platform 13. The further support member 18 can connect to the support member 17 at its interaction with the rung 5 of the ladder 3. The further support member 18 connects to the platform member 13 at an opposite part of the platform member 13. The further support member 18 can enter into the rung that the support member 17 enters. Alternatively, the further support member 18 can rest on the support member 17 to find structural support therefrom. As a further alternative, the further support member 18 can be connected to the support member 17 by an appropriate connector, connection, or binding, such as but not limited to, a clamp, tie, clasp, nut and bolt connection, or similar connector structure.

The further support member 18 can be extended by separate components 181 using the locking devices 10, as described above. A further description of these features is not provided for brevity purposes, since they have been described above.

An operation of the ladder scaffold device 1 will now be provided. The ladder scaffolding device 1 can be connected to a ladder 3 prior to the ladder 3 being raised on the surface on which access or work will be conducted. To insert the ladder scaffold device 1 into the ladder 3, the back frame members 25 and 27 are inserted into a rung 5 of the ladder 3. The back frame members 25 and 27 can be inserted into the rung and locked into place by a locking device as described with respect to FIGS. 7–13.

The platform support member 17 is then inserted into the a rung 5 that is positioned below the rung 5 that the back frame members 25 and 27 are inserted. Typically, the rung 5 that the platform support members 17 are inserted is at least one, possibly two rungs below the rung 5 that the back frame members 25 and 27 are inserted. The further support member 18 is either inserted into the rung that the platform support members 17 are inserted or supported on the platform support members 17 themselves.

The ladder 3 can then be raised, so the platform 13 is generally level so as to define a scaffold upon which an individual can use. The platform 13 can be pivoted in the direction of arrow 99 to permit the individual to climb above the platform 13. Thereafter, the platform 13 can be pivoted again to connect to the other side fame member and a scaffold is then defined.

The platform support members 17 and the further support member 18 can be adjusted, if needed, to stabilize and strengthen the platform 13 in its use position. The adjustment of the platform support members 17 can be done automatically if the platform support members 17 include a motive device 175, which can be done by the user before, after or while climbing the ladder 3 t the ladder scaffold device 1. The adjustment of the platform support members 17 presents the platform 13 with a generally planar orientation to present an even work surface for the user.

The user of the ladder scaffold device 1 then climbs the ladder 3, pivots the platform 13 as needed to climb above the platform frame 15, and then can pivot the platform 13 down into a generally planer orientation. The platform members 1331 and 132 can then be moved to a desired length and so they engage and lock with the side frame members 19 and 21, as described above. Therefore, the user of the ladder scaffold device 1 can be able to move across the platform 13 of the ladder scaffold device 1 and have a wider reach and work area, as compared to merely standing on the ladder.

The ladder scaffold device 1, as embodied by the invention and described above may merely comprise one-piece side frame members 19 and 21, a one-piece side front frame member 23, a one-piece side first back frame member 25, and a one-piece side second back frame member 27. With these one-piece members the ladder scaffold device 1 permits an extended work area, which is approximately the same length as the length of the one-piece members. The platform 13, I this situation, can also comprise a one piece member that pivots, as embodied by the invention and described above. Thus, the ladder scaffold device 1 can provide a very stable work area that finds support by its engagement with the rungs 5 of the ladder 3. Alternatively, the ladder scaffold device 1, as embodied by the invention and described above may merely comprise multi-piece frame members, such as multi-piece side frame members 19 and 21, multi-piece side front frame members 23, multi-piece side first back frame members 25, and multi-piece side second back frame members 27, in which the multi-piece members are connected and extendible by locking members as discussed above. Thus, the ladder scaffold device 1 may provide an even longer work area than that provided with the one-piece frame members The support members 17 and 18 of the ladder scaffold device 1 may also be provided as one-piece members or multi-piece members. The configuration of the multi-piece members for the support members can be as discussed above. The multi-piece members for the support members permit the support members 17 and 18 to snugly connect and fit between the rung 5 of the ladder 3 and the point at which they connect to the ladder scaffold device 1 at the frame members as illustrated. The snug fit and connection, as embodied by the invention, provides for enhanced stability and support at the farthest most regions of the platform 13. Of course, the platform 13 will be stable and adequately supported by the support members 17 and 19, as embodied by the invention.

The ladder scaffold device 1 as described above may be provided with a railing R (illustrated in phantom in FIG. 3) that attaches to the frame members of the ladder scaffold device 1. The railing R provides a further safety measure for the user of the ladder scaffold device 1.

Figure 20:
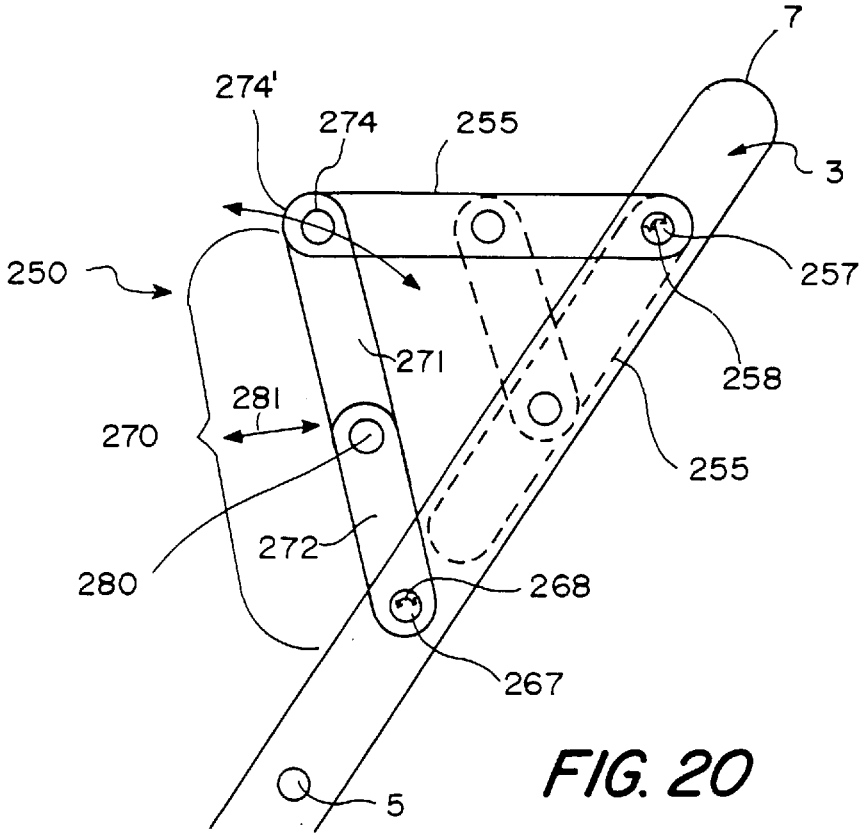
FIG. 20 is a schematic, part-sectional illustration of a further ladder scaffold device, as embodied by the invention.
Figure 21:
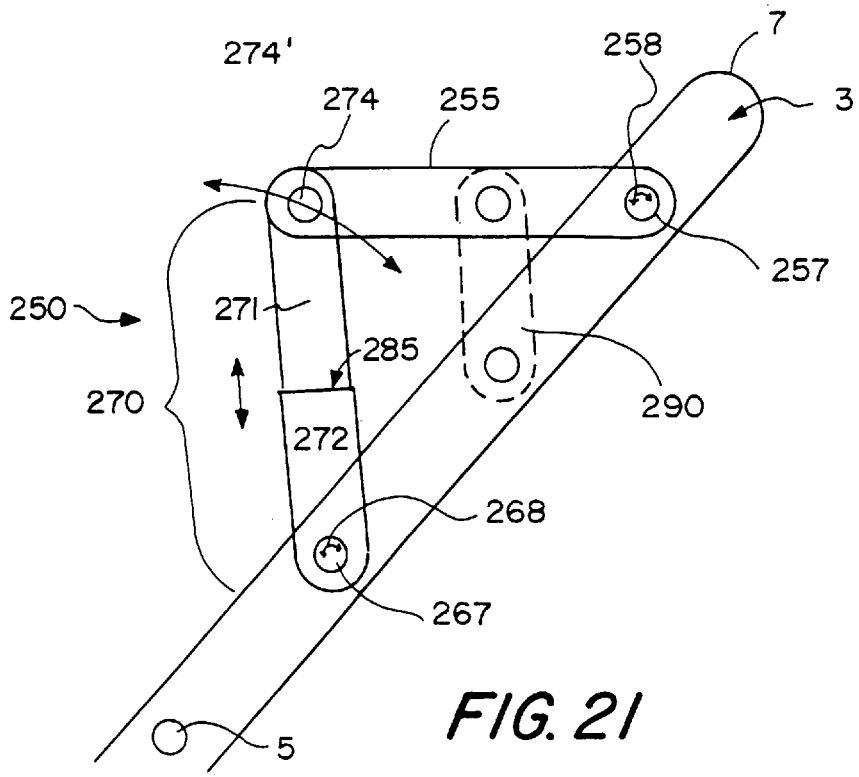
FIG. 21 is a schematic, part-sectional illustration of the further ladder scaffold device, as embodied by the invention.
Figure 22:
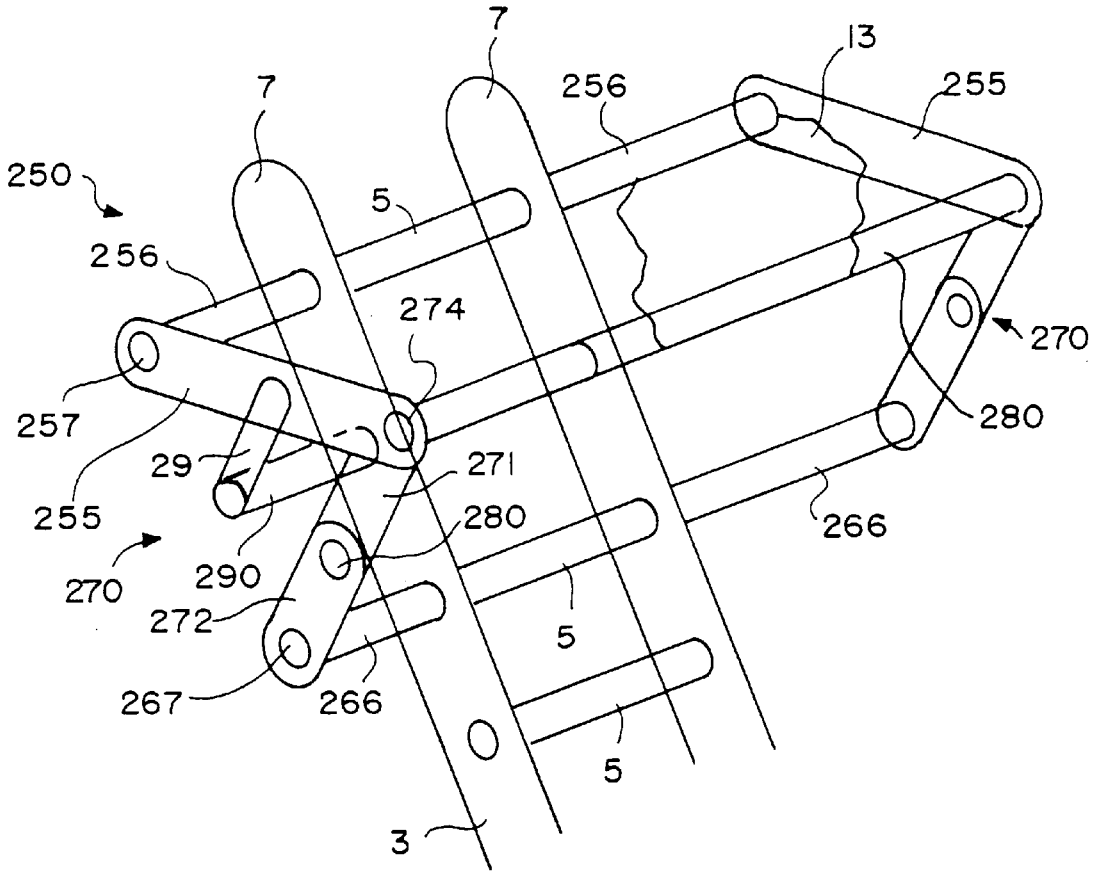
FIG. 22 is a schematic, part-sectional illustration of a further ladder scaffold device, as embodied by the invention.

FIGS. 20 illustrate a further ladder scaffold device 250 for providing an extended work area for a user. The features of the further ladder scaffold device 250 will be described with reference to the figures, and common elements will be referred to with like reference numbers. Where an element of the further ladder scaffold device 250 is essentially similar to the like element in the ladder scaffold device 1, as described above with respect to FIGS. 3–19, a further description will not be provided. FIGS. 20 and 21 are side schematic views of the further ladder scaffold device 250 and FIG. 22 is a partial side view of the further ladder scaffold device 250 in its extended form.

In FIG. 20, the further ladder scaffold device 250 is connected to a ladder 3 and is fit into at least one rung 5 of the ladder 3. The connection of the further ladder scaffold device 250 into the rungs is similar to the fit of FIGS. 5 and 6, and locking devices as illustrated in FIGS. 7–13. The further ladder scaffold device 250 is connected to the ladder 3 and can be extended from the ladder as explained hereinafter.

The further ladder scaffold device 250 includes side frame members 255. The side frame members 255 are connected to a rung extension 256 that is stored in a rung 5 of the ladder 3. The rung extension 256 and the side frame member 255 are connected to each other at a pivot 257 that allows the side frame member 255 to pivot in the direction of arrow 258 (FIGS. 20 and 21). The rung extension 256 may be locked in the rung 5 to limit its degree of extension from the rung 5. For example and in no way intending to limit the invention, the rung extension 256 may be limited in its extension by a locking device, including the locking devices as illustrated in FIGS. 7–13.

The further ladder scaffold device 250 also includes a lower rung extension 266 that extends from a rung 5, which is positioned below the rung 5 from which the upper rung extension 256 extends from the ladder 3. The lower rung extension 266 is pivotally connected to a further ladder scaffold device 250 support member 270 at a pivot 267, so as to pivot in the direction of arrow 268. The support member 270 is connected to the further rung extension 266 at one end and is connected to the side frame member 255. A front frame member 280 is connected to each side frame member 255, in a fashion to permit the platform 13 to be supported by the further ladder scaffold device 250.

The support member 270 is illustrated in FIG. 20 as comprising two support member components 271 and 272. The first support member 271 is pivotally connected to the side frame member 255 at pivot 274 to move in the direction of arrow 274' and is connected to the other (second) support component 272. The support member 272 is pivotally connected to the further rung extension 266 and is connected to the support component 271. The connection between each of the support member components 271 and 272 can comprise a pivot 280 so that it can pivot in the direction of arrow 281 in FIG. 20. Alternatively, the connection between each of the support member components 271 and 272 can comprise a piston/cylinder configuration 285, which permits the support member components 271 and 272 to telescopingly fit into each other, so they may be collapsed into each other, when the further ladder scaffold device 250 is moved from a stored position, as described hereinafter.

The further ladder scaffold device 250 may also include an additional support device 290 that can pivotally extend from an additional rung extension 296, and is removably connected to each side frame member 255. The additional support device 290 is optional in the further ladder scaffold device 250, and provides further stability and support for the platform 13 in the further ladder scaffold device 250.

In operation of the further ladder scaffold device 250, the side supports are stored in their stored position that is illustrated in phantom in FIG. 20. The operation of the further ladder scaffold device 250 will be described with respect to FIGS. 20 and 22, and the operation of the further ladder scaffold device 250 with the structure of FIG. 21, will be clear to those of ordinary skill in the art. In this position, the side support members 255 and the support member 270 are essentially aligned with the side rails 7 supports of the ladder 3. The rung extensions 256 and 266 are extended from the rungs 5 of the ladder 3, and the side support members 255 the support member 270 are pivoted about their respective pivots. The order of the extension and pivoting is not material to the operation of the further ladder scaffold device 250. Following the extension and rotation, the support member 270 is connected to the side support member 255 to define a support frame for the platform 13. If provided, the additional support member 290 can be connected in the further ladder scaffold device 250.

As with the ladder scaffold device 1, a railing R may be provided with the further ladder scaffold device 250.

The features of each ladder scaffold device 1, 250, and 300 as discussed above can be used separately, as discussed above. The scope of the invention comprises features of the ladder scaffold devices usable with each other and in combination with each other.

While embodiments of the invention have been described, the present invention is capable of variation and modification, and therefore should not be limited to the description herein. The invention includes changes and alterations that fall within the purview of the following claims. Individual components of the described and illustrated embodiments may be used interchangeably with each other component of the described and illustrated embodiments.

What is claimed:

1. A combination of a ladder and a ladder scaffold device, the ladder scaffold device defines a scaffold and work area for a user of the ladder scaffold device, the ladder defining an upper end and a lower end, and a plurality of rungs, the ladder scaffold device attaches to the upper end of the ladder and extends downwardly toward the lower end of the ladder and is capable of being inserted into at least one rung of the ladder, the ladder scaffold device comprising:

a platform;

a platform frame; the platform frame comprises a first back frame member, a second back frame member, first and second side frame members and a front frame member; the first back frame member and the second back frame member being supported by a first rung of the ladder and extendible from the first rung of the ladder, and a plurality of support members, the plurality of support members comprising platform support members and additional support members, the platform support members are capable of being inserted into a rung of the the plurality of support members comprising a first rung extension and a second rung extension, each of the first rung extension and the second rung extension being supported by a second rung of the ladder, the second rung of the ladder being disposed closer to the upper end of the ladder than the first rung of the ladder;

wherein the plurality of support members further comprise two support members each of which are connected to a respective one of the first and second back frame members and a respective one of the first and second rung extensions, the plurality of support members further comprise two additional support members each of which are connected to the front frame member and a respective one of the first and second rung extension, the front frame member being capable of being connected to the side frame members; further wherein the first back frame member, second back frame member, first and second side frame members, and front frame member can be connected and define said platform frame.

2. The combination according to claim 1, wherein the first back frame member, second frame member, first and second side frame members and front frame member each comprise multiple pieces.

3. The combination according to claim 1, wherein the additional support members comprise single piece support members.

4. The combination according to claim 1, wherein the platform comprises a pivoting connection to the platform frame so the platform may pivot about the platform frame to and from a generally planar position in which the platform defines the scaffold and work area and a pivoted position in which the platform allows access to the ladder above the platform.

5. The combination according to claim 1, wherein the platform comprises at least two platform sections that are in sliding cooperation with each other to define the platform.

6. The combination according to claim 1, wherein the first back frame member, second frame member, first and second side frame members, and front frame member each comprise single pieces; and each additional support member comprises multi-piece support members, the platform frame further comprises at least one locking device for locking each piece of the multi-piece support member in an extended and locked position.

7. The combination according to claim 1, further comprising a safety rail that is attached to at least one of the platform and platform frame.

* * * * *